US010203182B2

(12) United States Patent
Hall et al.

(10) Patent No.: US 10,203,182 B2
(45) Date of Patent: Feb. 12, 2019

(54) HELMET ACCESSORY ATTACHMENT SYSTEM

(71) Applicant: Revision Military S.a.r.L., Luxembourg (LU)

(72) Inventors: Edward R. Hall, Starksboro, VT (US); Pierre-Luc Lussier, Longueuil (CA); Nicolas Desjardins, Pincourt (CA); Dominic Giroux Bernier, St-Gabriel de Brandon (CA); Stéphane Lebel, St. Redempteur (CA)

(73) Assignee: Revision Military S.a.r.L., Luxembourg (LU)

( * ) Notice: Subject to any disclaimer, the term of this patent is extended or adjusted under 35 U.S.C. 154(b) by 109 days.

(21) Appl. No.: 15/284,454

(22) Filed: Oct. 3, 2016

(65) Prior Publication Data

US 2018/0092425 A1 Apr. 5, 2018

(51) Int. Cl.
*F41H 1/04* (2006.01)
*A42B 3/04* (2006.01)

(52) U.S. Cl.
CPC ..... *F41H 1/04* (2013.01); *A42B 3/04* (2013.01)

(58) Field of Classification Search
CPC ..... A42B 3/326; A42B 3/222; A42B 3/18; A42B 3/04; A42B 3/08; A42B 3/205; A42B 3/328
USPC ..... 2/422, 421, 424, 410, 411, 425
See application file for complete search history.

(56) References Cited

U.S. PATENT DOCUMENTS

| | | | | |
|---|---|---|---|---|
| 2,892,195 | A | 6/1959 | Monetta | |
| 3,216,023 | A * | 11/1965 | Morgan | A42B 3/08 128/857 |
| 4,042,974 | A * | 8/1977 | Morgan | A42B 3/326 2/424 |
| 5,003,632 | A | 4/1991 | Claude | |
| 7,908,667 | B2 | 3/2011 | Rogers et al. | |
| 9,700,096 | B2 * | 7/2017 | McGinn | A42B 3/18 |
| 9,788,593 | B2 * | 10/2017 | Lebel | A42B 3/222 |
| 2011/0113535 | A1 * | 5/2011 | Lebel | G02C 3/02 2/422 |
| 2011/0314594 | A1 * | 12/2011 | Rogers | A42B 3/04 2/421 |
| 2012/0117717 | A1 * | 5/2012 | McGinn | A42B 3/04 2/424 |

(Continued)

FOREIGN PATENT DOCUMENTS

| | | |
|---|---|---|
| CH | 670 744 A5 | 7/1989 |

OTHER PUBLICATIONS

U.S. Appl. No. 29/579,739, filed Oct. 3, 2016, Hall et al.

(Continued)

*Primary Examiner* — Gloria Hale
(74) *Attorney, Agent, or Firm* — Wolf, Greenfield & Sacks, P.C.

(57) ABSTRACT

A helmet accessory attachment member includes a finger-actuatable lock configured to secure an accessory attachment member mount to a helmet mount as part of securing an accessory such as a mandible guard to a helmet. The lock includes a pivot arm with a rotation axis that is parallel to the helmet surface, and also includes one or more blocking surfaces on the pivot arm to engage with grooves on the helmet mount. The lock may be positioned on a slidable insert of the accessory attachment member.

24 Claims, 10 Drawing Sheets

(56) References Cited

U.S. PATENT DOCUMENTS

| | | | | |
|---|---|---|---|---|
| 2014/0033406 | A1* | 2/2014 | Lebel et al. | A42B 3/326 2/422 |
| 2014/0075654 | A1* | 3/2014 | McGinn | A42B 3/326 2/422 |
| 2015/0135417 | A1 | 5/2015 | Lebel et al. | |
| 2015/0342283 | A1 | 12/2015 | Lebel et al. | |

OTHER PUBLICATIONS

U.S. Appl. No. 15/284,504, filed Oct. 3, 2016, Hall et al.
[No Author Listed], Moto Visor & Mandible for Sentry Image. NFM Group. Accessed Sep. 30, 2016. Available at: http://www.nfm.no/moto-visor--mandible-for-sentry,p.html. 2 pages.
[No Author Listed], Moto Visor & Mandible for Sentry. NFM Group. Accessed Sep. 30, 2016. Available at: http://www.nfm.no/moto-visor--mandible-for-sentry,p.html. 2 pages.
[No Author Listed], System Capabilities. NFM Group. Accessed Sep. 30, 2016. Available at: http://www.nfm.no/ops-core/system-capabilities.html. 3 pages.

* cited by examiner

HELMET ACCESSORY ATTACHMENT SYSTEM

FIELD

Aspects of the present disclosure relate generally to helmet assemblies, and more particularly to helmet accessory attachment systems.

DISCUSSION OF THE RELATED ART

Members of the military and law-enforcement often wear protective headgear, such as helmets. Various helmet accessories are available to enhance safety and provide different functionalities, such as a face shield or a mandible guard.

SUMMARY

According to one embodiment, a helmet accessory attachment system includes a helmet mount having a helmet-facing surface, and an accessory attachment member having an accessory attachment member mount configured to engage with the helmet mount such that the engagement of the accessory attachment member with the helmet mount supports the accessory attachment member from the helmet mount. The system also includes a lock to secure the accessory attachment member to the helmet, the lock including a pivot arm and a first blocking surface, and the pivot arm having an unlocked position and a locked position. The pivot arm is pivotable about a pivot axis that is not perpendicular to the helmet-facing surface of the accessory attachment member mount at the pivot axis location. When the pivot arm is in the locked position, the first blocking surface is positioned relative to a second blocking surface on the helmet mount to prevent movement of the accessory attachment member mount relative to the helmet mount.

According to another embodiment, a mandible guard attachment system includes a helmet mount having a helmet-facing surface, and a mandible guard attachment member having a mandible guard attachment member mount configured to engage with the helmet mount such that the engagement of the mandible guard accessory attachment member mount with the helmet mount supports the accessory attachment member from the helmet mount. The system also includes a lock to secure the mandible guard accessory attachment member to the helmet, the lock including a pivot arm and a first blocking surface, and the pivot arm having an unlocked position and a locked position, wherein the lock is positioned on the mandible guard attachment member mount. When the pivot arm is in the locked position, the first blocking surface is positioned relative to a second blocking surface on the helmet mount to prevent movement of the accessory attachment member mount relative to the helmet mount.

According to a further embodiment, A helmet accessory attachment system includes a helmet mount having a helmet-facing surface, and a helmet accessory attachment member having a slidable insert configured to engage with the helmet mount such that the engagement of the slidable insert with the helmet mount supports the helmet accessory attachment member from the helmet mount. The system also includes a lock to secure the helmet accessory attachment member to the helmet, the lock including a pivot arm and a first blocking surface, and the pivot arm having an unlocked position and a locked position, wherein the lock is positioned on the slidable insert. When the pivot arm is in the locked position, the first blocking surface is positioned relative to a second blocking surface on the helmet mount to prevent movement of the slidable insert to the helmet mount. When the pivot arm is in the locked position, the first blocking surface protrudes from an underside of the slidable insert.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
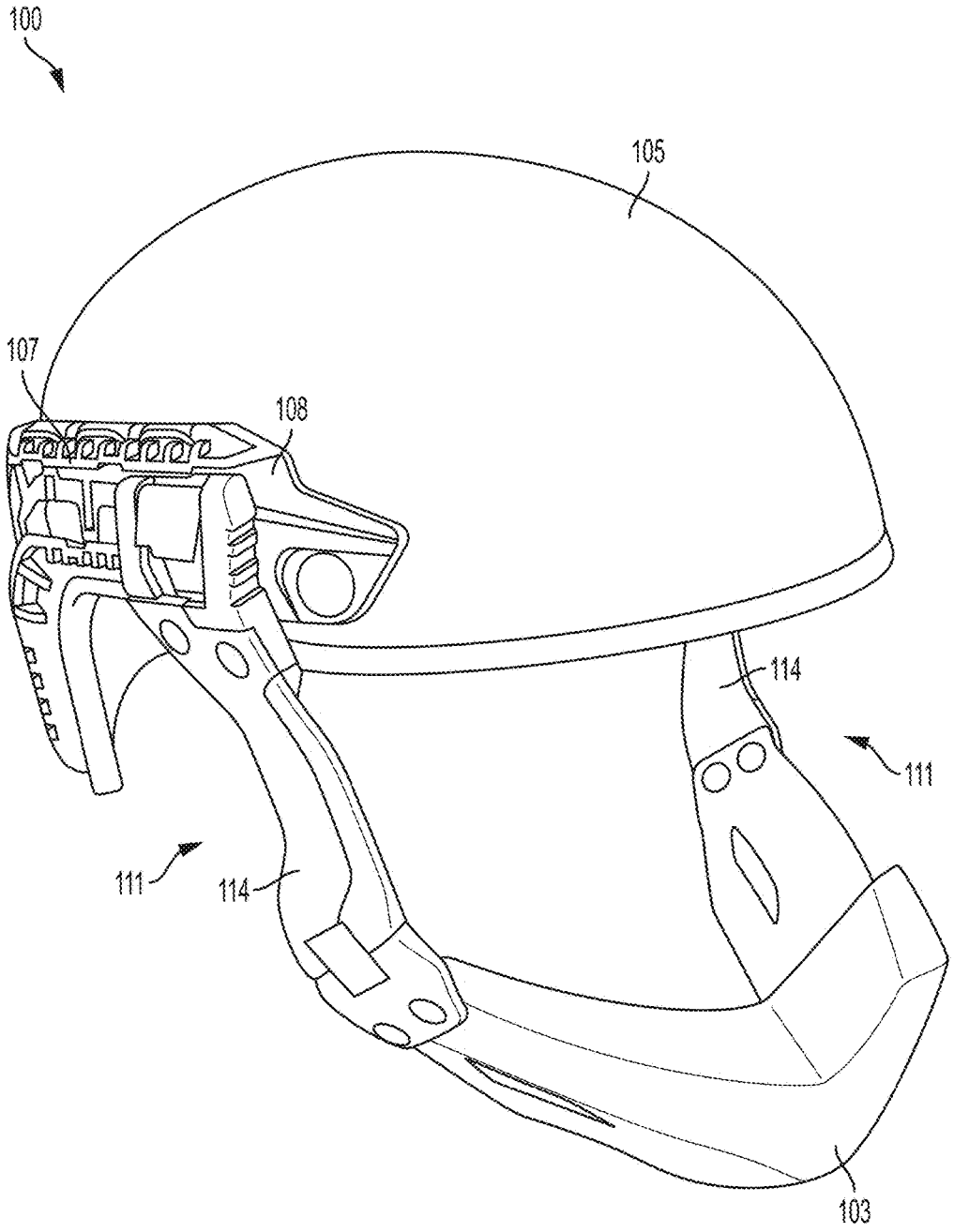
FIG. 1 is a left side perspective view of a helmet, a helmet accessory attachment system, and a mandible guard according to one embodiment.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with a helmet assembly, such as a military combat helmet. However, the invention is not necessarily so limited, and may be employed with other types of helmets, particularly helmets suitable for high impact activities. For ease of understanding, the helmet assembly is described in connection with a military combat helmet, which may be a ballistic or non-ballistic helmet.

Mandible guards may be permanently or removably mounted to helmets to provide jaw and face protection from projectiles or other dangers. Applicant has recognized that the ability to conveniently attach and remove (partially or fully) a mandible guard to enable access to the lower half of the face may be helpful for comfort and safety in high-risk environments. Applicant has recognized that such functionality may be achieved with an attachment system that allows the mandible guard to be attached to only one side of the helmet such that the mandible guard is free on the other side of the helmet. Additionally, some embodiments of attachment systems disclosed herein permit a wearer to conveniently attach, secure, unsecure, and/or remove a mandible guard from one side of a helmet using only one hand.

Attachment systems for mandible guards disclosed herein may include two accessory attachment members, one on each side of the helmet, and each accessory attachment member may be attached to the helmet at a helmet mount. In one embodiment, the mandible guard may be partially removed such that the mandible guard is attached to the helmet by only one accessory attachment member, and the mandible guard is movable away from a wearer's face. Such embodiments may provide the wearer full access to the mouth area, which enables activities like eating, drinking, and spitting, without entirely removing the mandible guard. The arrangement also may enable efficient reattachment of a second accessory attachment member to return the mandible guard to the protection position.

According to some embodiments disclosed herein, an attachment arrangement is provided whereby a wearer can easily attach and secure an accessory attachment member to a helmet mount. The attachment accessory member is initially attached to the helmet mount by engaging a helmet accessory attachment member mount with the helmet mount. For example, the accessory attachment member may include a slidable block that is inserted into an elongate slot of the helmet mount to initially attach the accessory attachment member to the helmet. A finger-actuatable lock may be used to secure the slidable block within the elongate slot. The structure of the lock may be such that unintentional disengagement of the lock is unlikely. The lock may include a pivot arm which allows for straightforward, finger-actuatable unlocking so that the wearer, without the use of a tool, can easily unlock the accessory attachment arm and remove the attachment accessory member from the slot to release the accessory attachment arm from the helmet mount.

In some embodiments, the elongate slot may be any structure that includes an opening and a receiving area to receive a portion of the accessory attachment member. For example, the elongate slot may include any suitably shaped recess or cutout sized to accept and retain a portion of the movable member's outer periphery.

In some embodiments, the lock includes a protrusion with a first blocking surface. When the lock is in a disengaged position, the accessory attachment member mount is movable relative to the helmet mount. When the accessory attachment member mount is engaged with the helmet mount and the lock is in the locked position, the first blocking surface of the protrusion interacts with a second block surface of the helmet mount to prevent movement of the accessory attachment member relative to the helmet mount. In some embodiments, the second blocking surface is a restraint, a barrier, a narrowing channel, or other impediment which prevents motion of the accessory attachment member mount (such as a slidable block) toward the slot opening where the accessory attachment member mount may be released from the helmet mount.

The first blocking surface of the lock may be fixed to a lock actuator, and the blocking surface may be movable to a locked position in which the blocking surface protrudes from an underside of the slidable block in some embodiments. In some embodiments, the locking actuator is a pivot arm that moves the lock between the locked and unlocked positions without the use of a tool. For the sake of clarity, the embodiments herein are described with reference to a pivot arm, though other configurations of a lock actuator are contemplated.

When the pivot arm is initially in the unlocked position, the pivot arm may be biased toward the unlocked position for a first part of the rotation and toward the locked portion for a second part of the rotation. When the pivot arm is initially in the locked position, the pivot arm may be biased toward the locked position for part of the rotation and toward the unlocked position for a second part of the rotation. Such an arrangement may help keep the pivot arm in its existing state until the wearer intentionally moves the arm to the other state. For example, the pivot arm may be biased toward the locked position by a biasing element such as a spring, a cantilever, or other suitable device capable of applying a force to the pivoting member. In some embodiments, the pivoting member may not be biased. In some embodiments, the pivot arm is not biased throughout an entire rotation, but instead encounters a protrusion or other impediment that requires a threshold force on the pivot arm to overcome.

When it is desired to mount the mandible guard (or other accessory) to a helmet, a user positions the accessory attachment member mount, such a slidable block, in the opening of the elongate slot on the helmet mount. The slidable block is then moved into the elongate slot away from the opening until a stopping surface engages with the helmet mount to prevent further sliding inwardly. Once the stopping surface abuts the mount, the user may rotate the pivot arm toward the locked position.

When the pivot arm is in the locked position, the first blocking surface of the lock engages with a corresponding groove in the elongate slot, and a blocking surface of the groove constrains the slidable block's movement within the slot. This constraint secures the accessory attachment member to the helmet mount and locks it into position.

To remove the accessory attachment member from the helmet mount, the user pulls the pivot arm toward the unlocked position. Due to a biasing element or other resistance, rotation of the pivot arm is resisted until a threshold force is achieved and/or a certain amount of rotation occurs. When the blocking surface is disengaged from the corresponding groove in the elongate slot, the slidable block may be slid toward the opening of the elongate slot and removed from the elongate slot. In some embodiments, this system permits a user to attach and remove the accessory attachment member from the helmet mount using a single hand.

Figure 2:
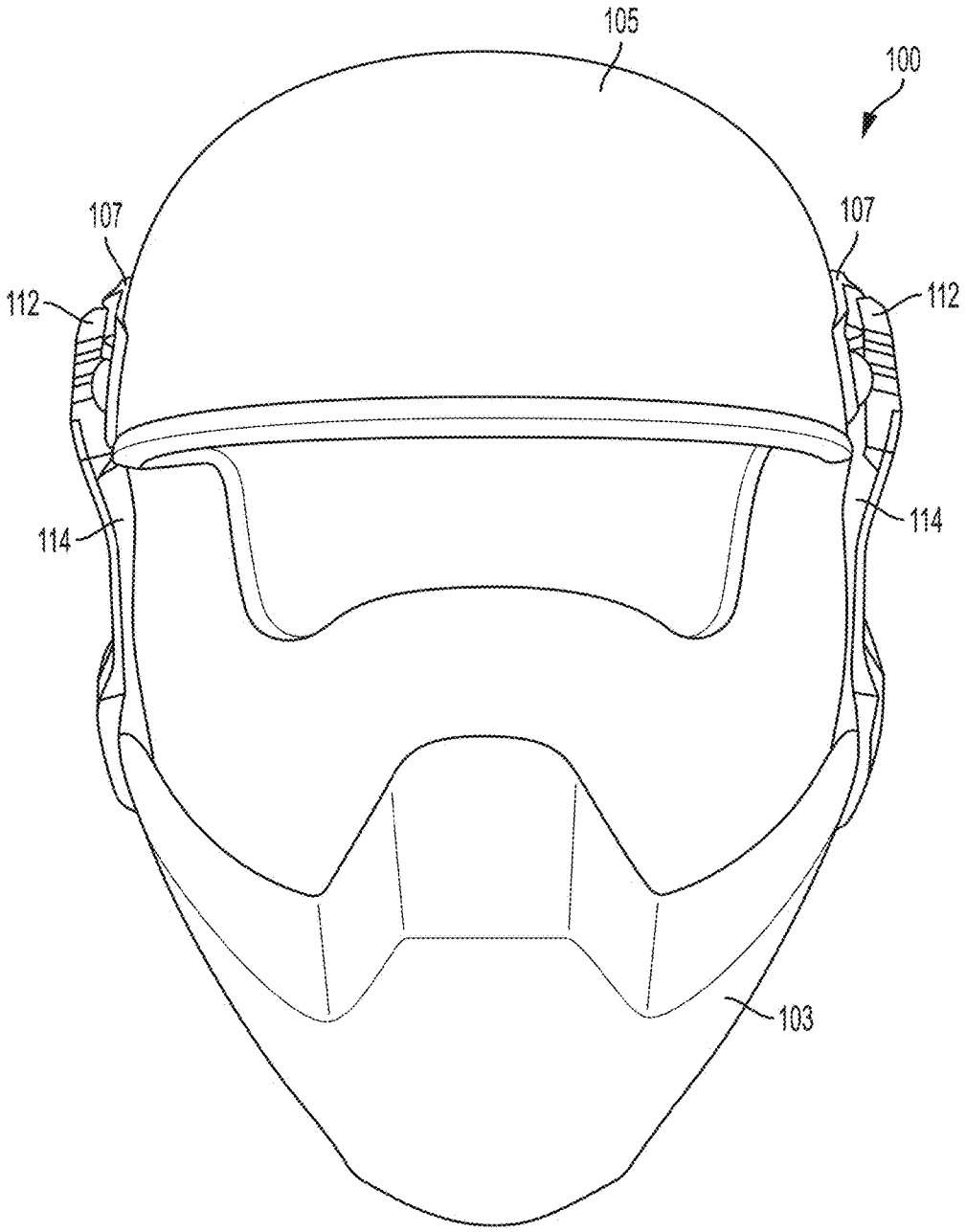
FIG. 2 is a front view of the embodiment shown in FIG. 1.

Turning now to the figures, FIGS. 1-2 show an embodiment of a helmet assembly 100, the assembly including one embodiment of an accessory attachment system used to selectively attach a mandible guard 103 to a helmet 105. The helmet 105 and/or mandible guard 103 may be military helmets and/or be ballistic rated. For example, the helmet and/or mandible guard may meet at least ballistic threat level I, at least ballistic threat level IIA, at least ballistic threat level II, at least ballistic threat level IIIA, at least ballistic threat level III, and/or at least ballistic threat level IV, per the Ballistic Resistance of Body Armor NIT Standard—0101.06 dated July 2008. Accessory attachment rails 107 are attached to each side of the helmet in some embodiments, and may include elastic cords, various protrusions and recesses, and/or other components for mounting various accessories to the helmet.

The mandible guard attachment system includes helmet mount 108 an elongate slot 109 (see FIG. 6) within each rail 107. Accessory attachment members 111 each include an accessory attachment member mount 112, and each mount 112 includes a slidable insert 115 (see FIG. 7) which is slidingly insertable into elongate slot 109 via an opening 127 (see FIG. 9). The slidable insert 115 is securable to the helmet mount by rotating a pivot arm 116 to a locked position, as discussed further below. The accessory attachment members 111 also include accessory attachment member arms 114 which extend to a connection region with the mandible guard 103.

Figure 3:
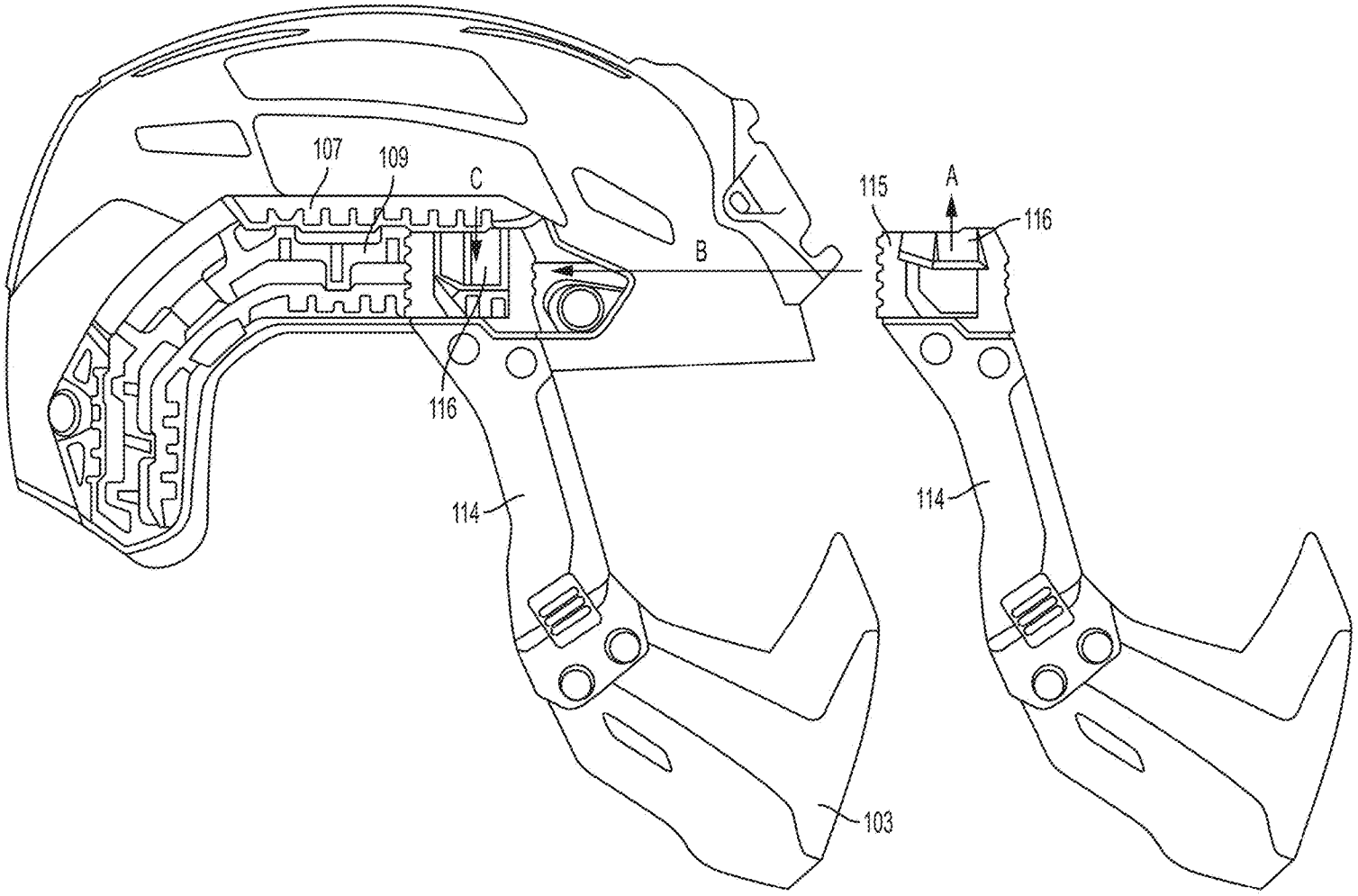
FIG. 3 is a left side view of the embodiment of FIGS. 1 and 2 with the accessory attachment system shown attached to and removed from the helmet.

FIG. 3 shows the mandible guard in two separate positions—removed from the helmet and secured to the helmet. To attach the mandible guard to the helmet, the pivot arms 116 are pivoted upwardly (see arrow A) and the slidable inserts 115 are slid (see arrow B) into the elongate slots 109. Once the slidable inserts are inserted into the slots, the accessory attachment members 111 and the mandible guard are supported by the engagement of the accessory attachment members 111 with the helmet mounts 108.

Figure 4:
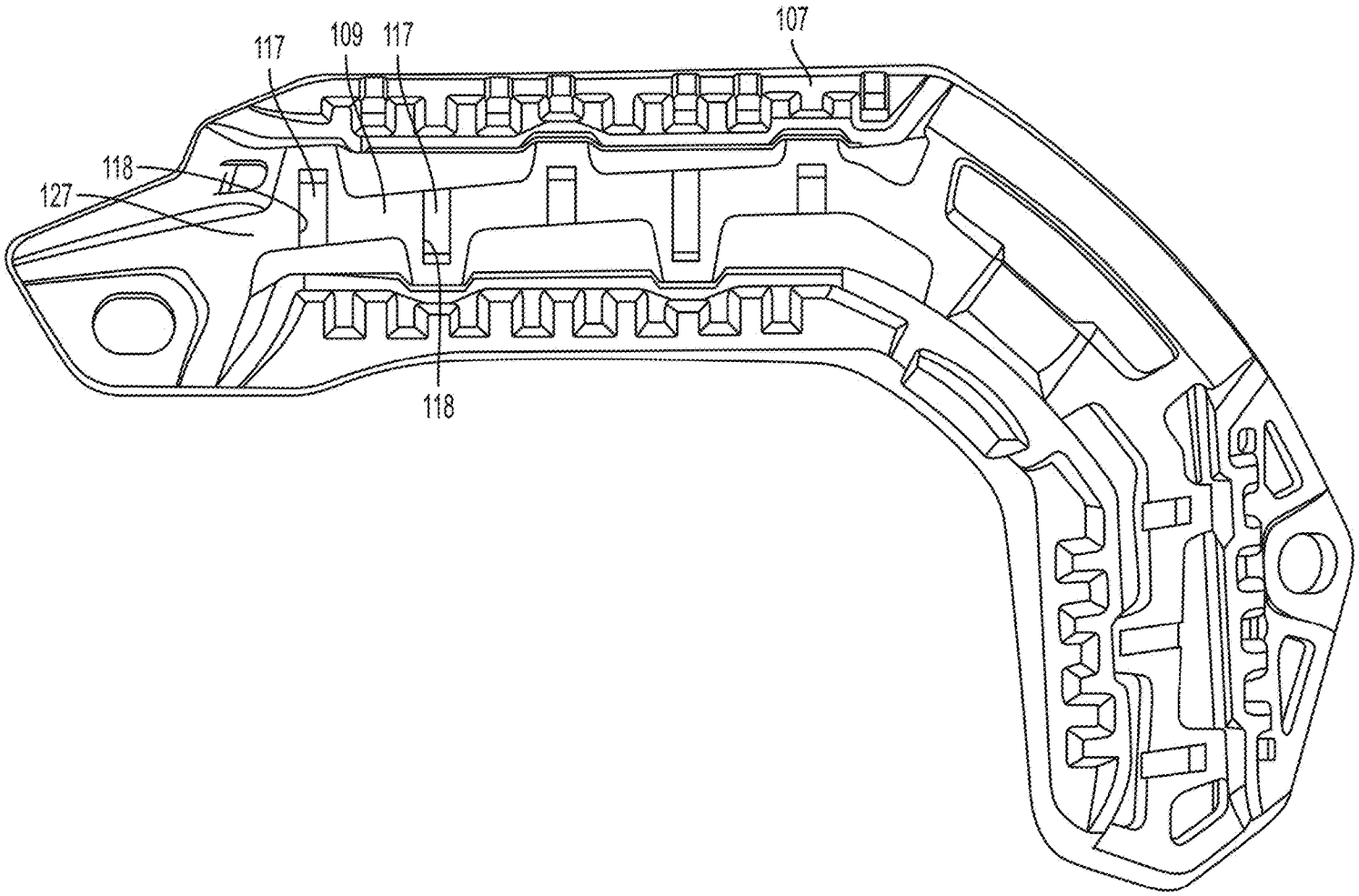
FIG. 4 shows one embodiment of a helmet mount.

The accessory attachment members may then be fully secured to the helmet mounts by pivoting the pivot arms 116 downwardly (see arrow C) until their respective lock protrusions are inserted into corresponding grooves in the rails 107. Grooves 117 in one rail 107 are shown in FIG. 4. By inserting the lock protrusions 131, 133 into the grooves 117, each slidable insert 115 is prevented from sliding in a direction toward the openings 127 of the elongate slots 109, thereby fully securing the accessory attachment member to the helmet mount. When in the locked position, the pivot arms may be substantially flush with an outer surface of the accessory attachment member so that the pivot arms do not present a snag hazard. An open or recessed area may be provided immediately under the pivot arm so that a wearer can fit his or her finger below the pivot arm when unlocking the pivot arm. The pivot arm is illustrated as a substantially flat plate in some embodiments, but the pivot arm may include other arrangements such as a curved surface, a rod, or any other suitable arrangement. The lock, including the pivot arm, is positioned on the slidable insert 115 at a temple region of the helmet in the embodiment shown in FIG. 1.

In the illustrated embodiment, two grooves 117 are arranged on each rail 107 to correspond to two lock protrusions on the corresponding accessory attachment member. Each groove 117 includes a blocking surface 118 that prevents movement of the corresponding lock protrusion toward the opening of the elongate slot 109. In some embodiments, a single groove and a single lock protrusion may be used. In other embodiments, three or more grooves and corresponding lock protrusions may be used. The one or more blocking surfaces 131, 133 of the helmet mount 108 do not necessarily need to be formed within a groove, but may instead be positioned on a protrusion.

Figure 5:
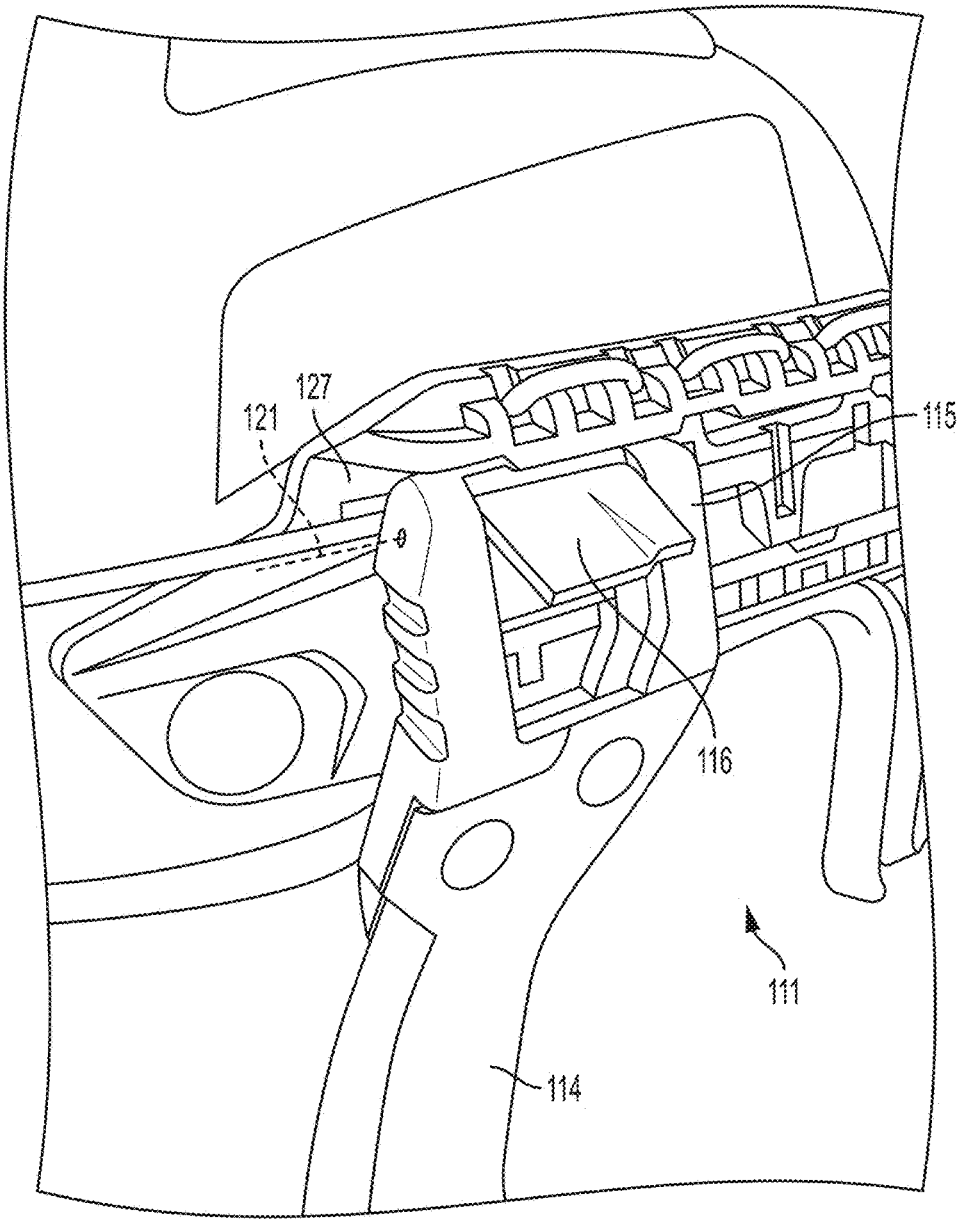
FIG. 5 shows an accessory attachment member engaged but not secured to a helmet mount according to one embodiment.

FIG. 5 shows accessory attachment member 111 engaged with elongate slot 109, but not secured as the pivot arm 116 is raised. To align the lock protrusions of the pivot arm with the grooves of the helmet mount, the slidable insert 115 may include a stopping surface to limit how far the slidable insert can be moved along the elongate slot 109, as discussed further below.

The pivot arm 116 has a pivot axis 121 which is substantially parallel to the helmet surface that lies below the pivot axis in some embodiments. In the embodiment illustrated in FIG. 5, pivot axis 121 is also parallel with a longitudinal direction of elongate slot 109. However, in some embodiments, the pivot axis may be perpendicular or otherwise orthogonal to the longitudinal direction of elongate slot 109 while still being substantially parallel to the underlying helmet surface. In this manner, for example, the pivot axis of pivot arm 116 may be vertically oriented instead of having the horizontal arrangement illustrated in FIG. 5. For purposes of this description, the terms "vertical" and "horizontal" are used with reference to the orientation of the helmet in FIG. 2. In some embodiments, the pivot axis of pivot arm 116 may be oriented diagonally, that is, such that it has both horizontal and vertical components to its angle, while still being substantially parallel to the underlying helmet surface. For purposes herein, the pivot axis being substantially parallel to the underlying helmet surface means that the an imaginary line extended from the pivot axis forms an angle of no more than 25 degrees with a plane tangent to the underlying helmet surface. For purposes herein, the pivot axis being substantially parallel to the helmet-facing surface of the accessory attachment member mount at the pivot axis location means that an imaginary line extended from the pivot axis forms an angle of no more than 25 degrees with the helmet-facing surface of the accessory attachment member mount. In some embodiments, the pivot arm pivot axis is parallel to the underlying helmet surface and/or the helmet-facing surface of the accessory attachment member mount.

In some embodiments, and particularly in embodiments where an elongate slot is integrally molded into the helmet, the pivot axis of the pivot arm may be parallel to a base surface of the elongate slot. In some embodiments, such as the embodiment shown in FIG. 5, the pivot axis is parallel to a helmet-facing surface of the accessory attachment member mount (e.g., the slidable insert).

Figure 6:
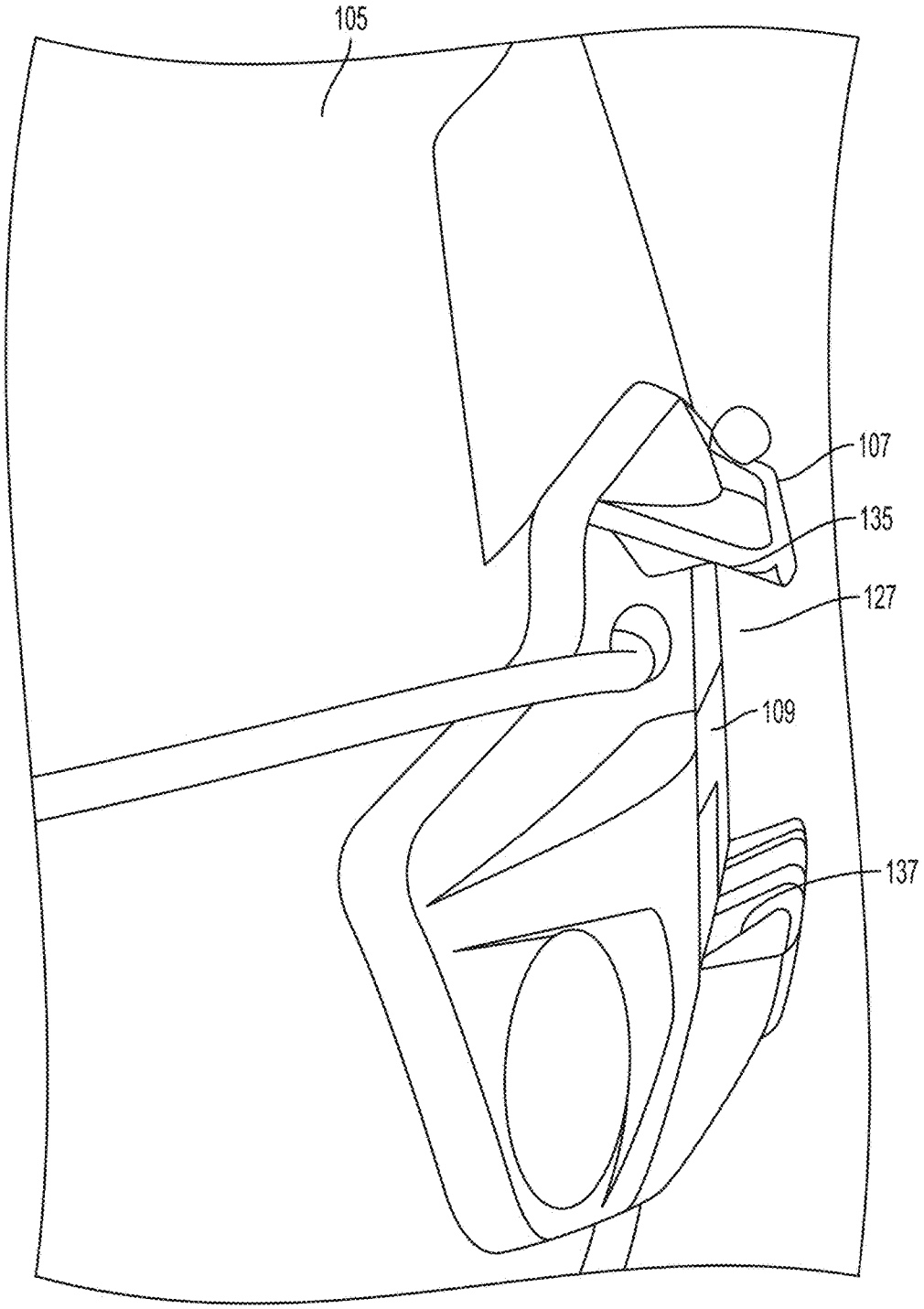
FIG. 6 is a front view of an elongate slot and top and bottom undercut surfaces.

FIG. 6 shows one embodiment of an elongate slot 109 in which the elongate slot 109 forms one portion of a sliding dovetail. The top and bottom surfaces 135, 137 of the slot 109 are undercut to form triangular recesses that are capable of retaining corresponding portions on the accessory attachment member 111 (See FIG. 7). This arrangement prevents the accessory attachment member from being removed from the elongate slot 109 in any direction other than along the longitudinal direction of the slot. In this manner, when the slidable insert of the accessory attachment member is inserted into the elongate slot 109, the engagement of the accessory attachment member with the helmet mount supports the accessory attachment member from the helmet mount. In other embodiments, the recesses could include a semicircular or other suitably shaped recess or cutout sized to accept and retain a portion of the outer periphery of the slidable insert.

Figure 8:
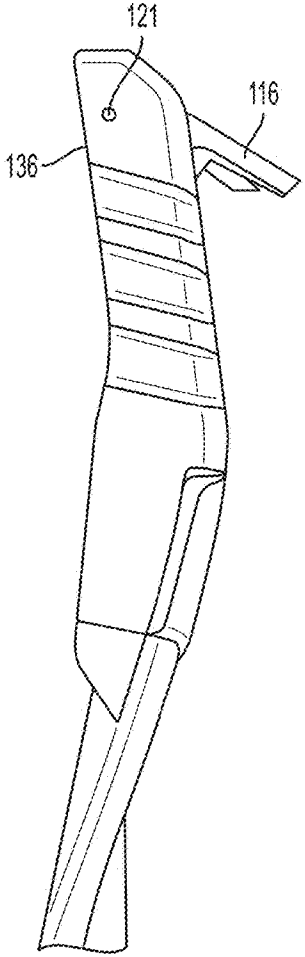
FIG. 8 is a perspective rear view of the arrangement of FIG. 7.
Figure 7:
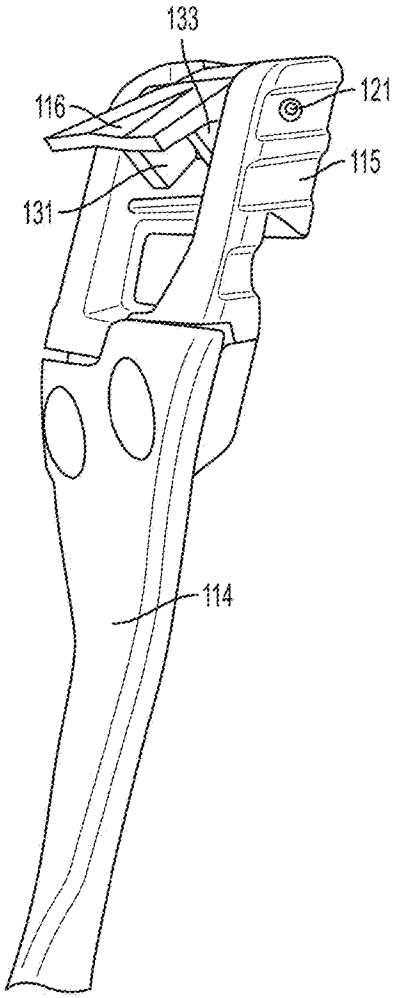
FIG. 7 is a front view of an accessory attachment member mount with a pivot arm in an unlocked position.

FIG. 7 shows a sliding insert 115 with a complementary shape to the elongate slot shown in FIG. 6. Pivot arm 116 is shown in the unlocked position, and first and second lock protrusions 131, 133 are visible on the underside of the pivot arm 116. With the pivot arm in the raised, unlocked position, the first and second lock protrusions 131, 133 do not protrude from and underside surface 136 of the sliding insert 115, as may be seen in FIG. 8.

Figure 10:
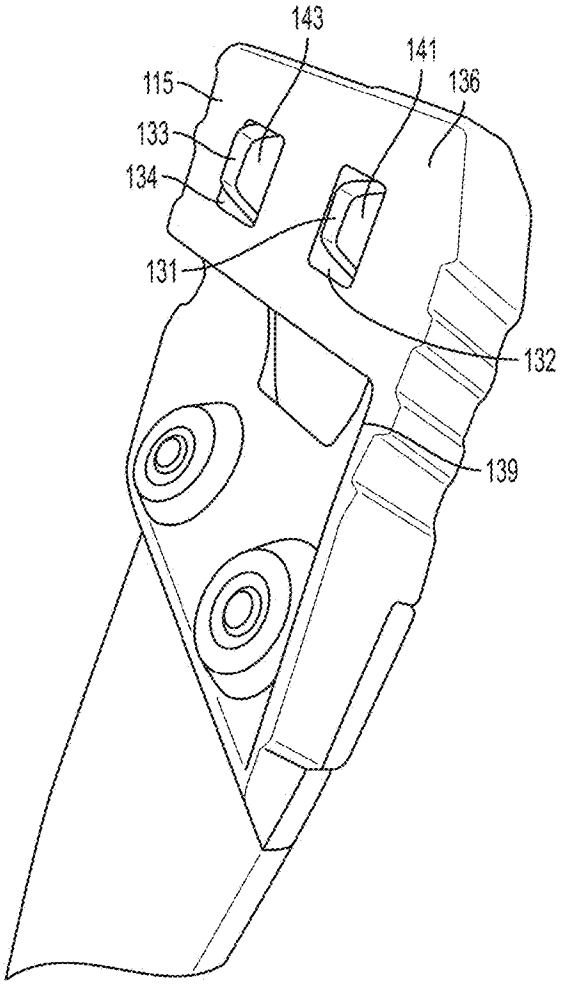
FIG. 10 is a perspective rear view of the arrangement of FIG. 9.
Figure 9:
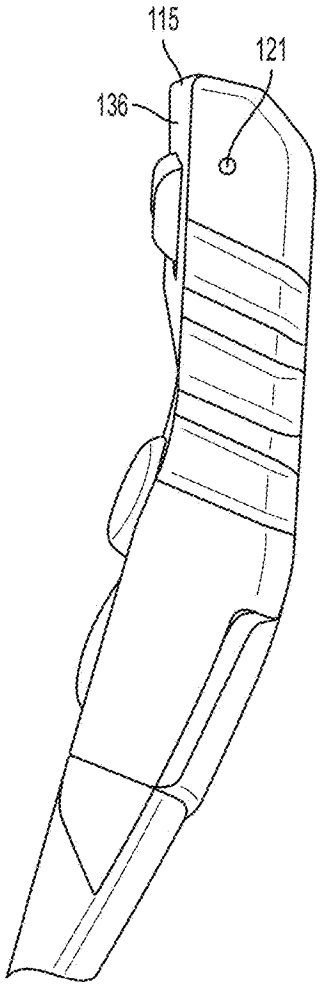
FIG. 9 is a front view of an accessory attachment member mount with a pivot arm in a locked position.

FIGS. 9 and 10 show the lock in the locked position (e.g., with the ticket arm lowered), with the first and second lock protrusions 131, 133 protruding through openings 132, 134 in the underside surface 136 of the sliding insert 115. Blocking surfaces 141, 143 are positioned to contact corresponding blocking surfaces of the grooves 117 positioned in the helmet mount. With such an arrangement, when the lock protrusions 131, 133 are in the locked position, the accessory attachment member is prevented from moving out of the elongate slot 109 in the elongate slot direction.

A lock protrusion is considered to be positioned on the pivot arm even if the protrusion is not directly attached to the portion of the pivot arm that the wearer grips. That is, protrusions that are connected to the pivot arm assembly and rotate when the pivot arm rotates are considered to be included on the pivot arm.

A stopping surface 139 may be provide to limit how far into the elongate slot the accessory attachment member can be inserted. Such an arrangement can align the one or more blocking surface of the lock with the grooves on the helmet mount in some embodiments. Additionally, the stopping surface may provide a consistent positioning of the mandible guard on the helmet.

Figure 11:
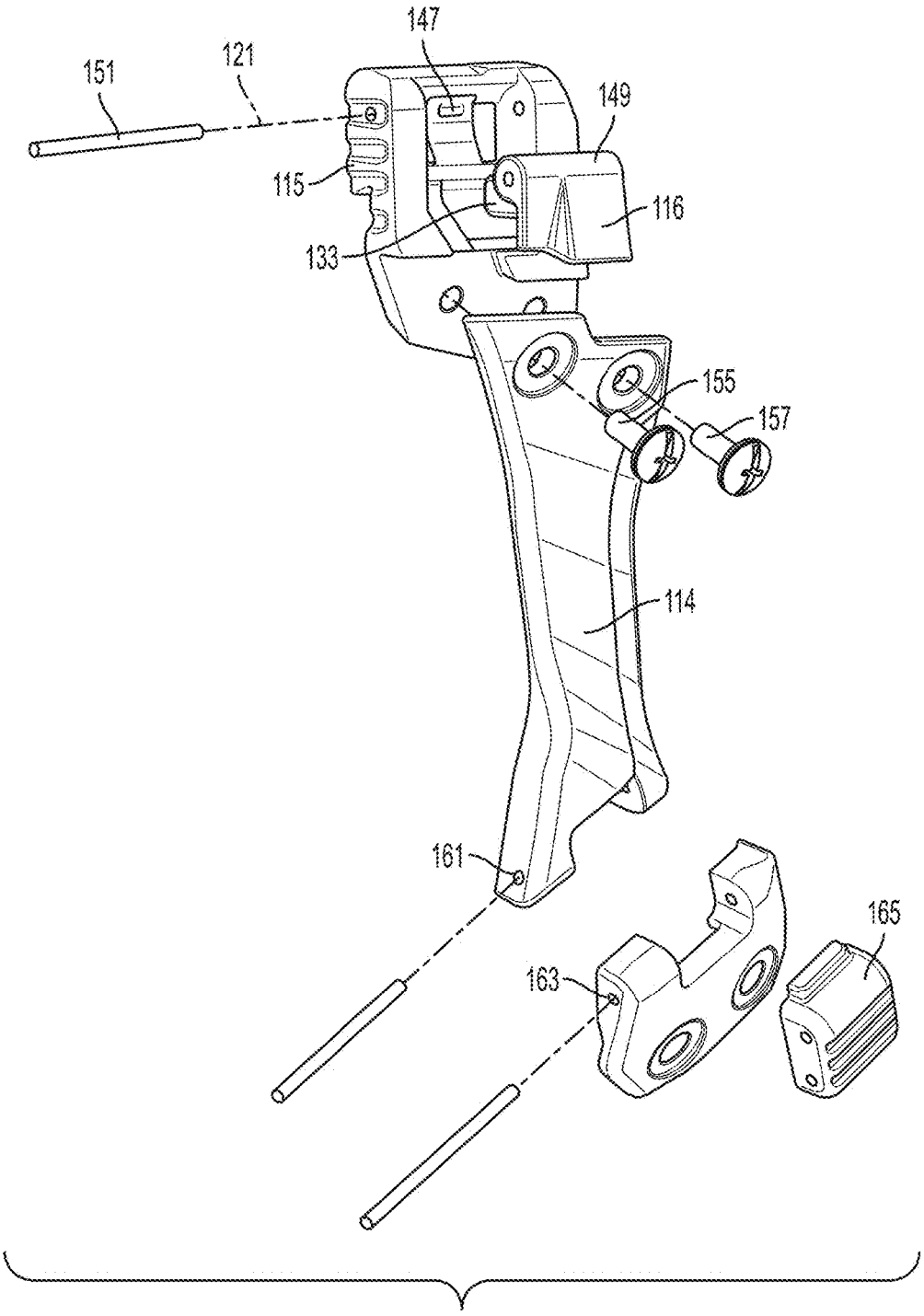
FIG. 11 is an exploded view of an accessory attachment member according to one embodiment.

FIG. 11 shows an exploded view of the accessory attachment member 111. Visible in this view is a bump 147 which holds the pivot arm in the locked position by interacting with a corresponding bump (not shown) on a cylindrical portion 149 of the pivot arm to form a snap lock. The two bumps are constructed and arranged such that when the pivot arm is in the locked position, little or no rotation is permitted until a threshold force is applied to the lever arm that is sufficient to move one bump past the other. Similarly, to put the pivot arm into a locked position, the two bumps may require that the pivot arm is moved with at least a threshold force. In other embodiments, bumps, other protuberances, or other components may be arranged such that there is resistance to moving the pivot arm away from the locked position, but there is little or no resistance to moving the pivot arm to the locked position.

Pivot arm 116 may be pivotally attached to the slidable insert 115 with a cylindrical pin 151. A pin is not required however, and any other suitable pivoting arrangement may be used. In some embodiments, instead of a pivoting arrangement, a purely translational movement may be used to put the accessory attachment member in a locked position.

The accessory attachment member arm 114 may be attached to the slidable insert portion of the accessory attachment member with rivets 155, 157 or any other suitable fastener(s). The connection of the arm 114 to an accessory (e.g., mandible guard) may include two pivot arrangements 161, 163 connected with an intermediate member 165.

Figure 12:
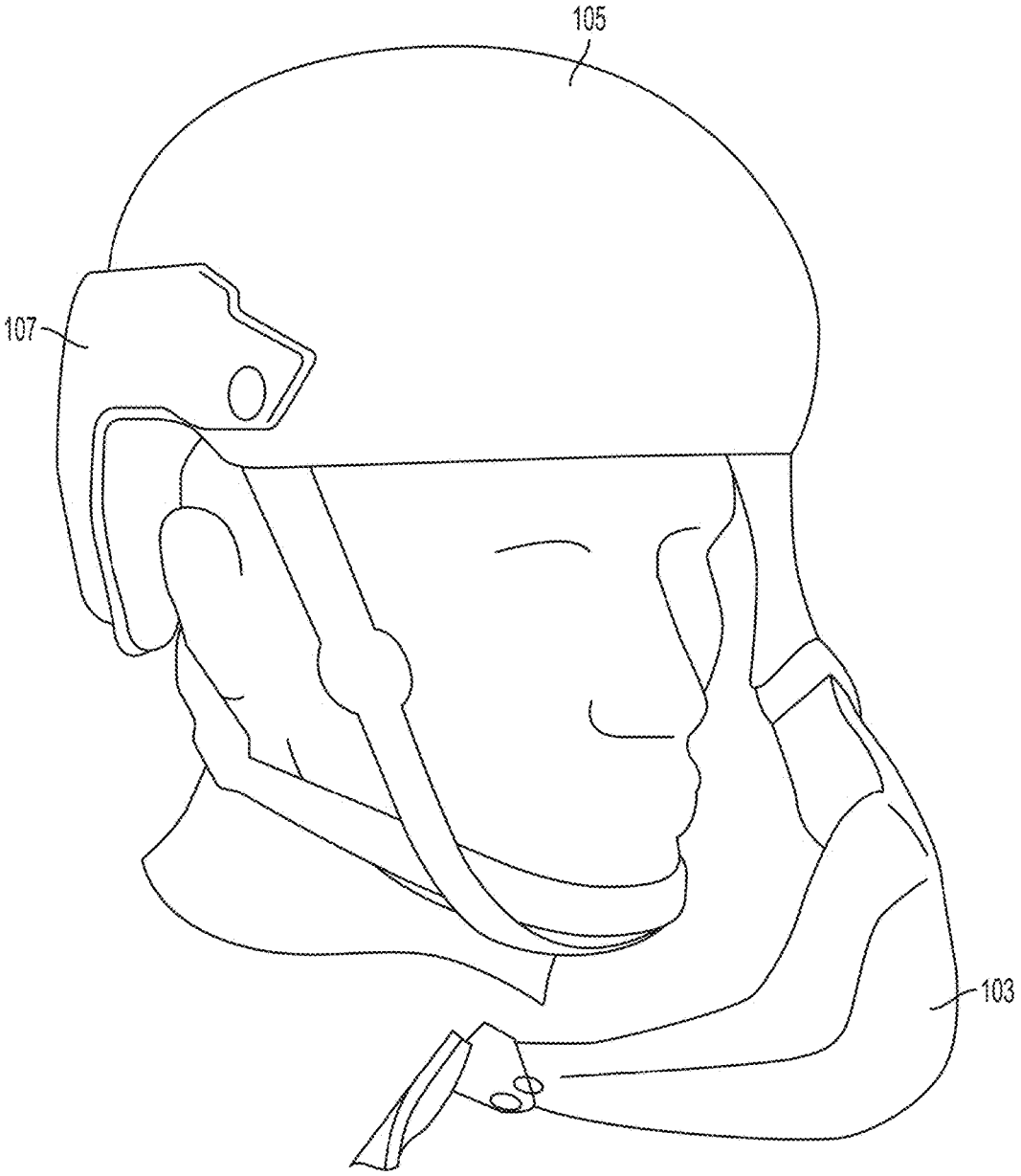
FIG. 12 shows a mandible guard detached from one side of a helmet.

In some embodiments, the user may be able to remove the accessory attachment member 114 from the helmet mount on a first side of the helmet 105 without removing the accessory attachment member from the other side of the helmet. In some embodiments, disengaging a single side allows the mandible guard to hang from the helmet by the accessory attachment member that remains attached, as may be seen in FIG. 12. The mandible guard 5 may be able to move in a variety of manners while remaining attached to one side of the helmet. For example, the mandible guard may have a hinged connection between the guard and the accessory attachment member.

The use of "including," "comprising," "having," "containing," "involving," and/or variations thereof herein, is meant to encompass the items listed thereafter and equivalents thereof as well as additional items.

The above aspects and embodiments may be employed in any suitable combination, as the present invention is not limited in this respect. It should also be understood that, unless clearly indicated to the contrary, in any methods claimed herein that include more than one step or act, the order of the steps or acts of the method is not necessarily limited to the order in which the steps or acts of the method are recited.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A helmet accessory attachment system configured to attach a helmet accessory to a helmet, the attachment system comprising:

a helmet mount having a helmet-facing surface;

an accessory attachment member having an accessory attachment member mount configured to engage with the helmet mount such that the engagement of the accessory attachment member with the helmet mount supports the accessory attachment member from the helmet mount;

a lock to secure the accessory attachment member to a helmet, the lock including a pivot arm and a first blocking surface, and the pivot arm having an unlocked position and a locked position;

wherein the pivot arm is pivotable about a pivot axis that is not perpendicular to the helmet-facing surface of the accessory attachment member mount at the pivot axis location; and wherein when the pivot arm is in the locked position, the first blocking surface is positioned relative to a second blocking surface on the helmet mount to prevent movement of the accessory attachment member mount relative to the helmet mount.

2. The helmet accessory attachment system as in claim 1, wherein the pivot arm pivot axis is substantially parallel to the helmet-facing surface of the accessory attachment member mount at the pivot axis location.

3. The helmet accessory attachment system as in claim 1, wherein the pivot arm pivot axis is parallel to the helmet-facing surface of the accessory attachment member mount at the pivot axis location.

4. The helmet accessory attachment system as in claim 1, wherein the helmet mount includes an elongate slot, and the accessory attachment member mount includes a slidable insert which is slidable within the elongate slot to engage the slidable insert with the helmet mount.

5. The helmet accessory attachment system as in claim 4, wherein the pivot arm pivot axis is parallel to a longitudinal direction of the elongate slot.

6. The helmet accessory attachment system as in claim 4, wherein the pivot arm is attached to the slidable insert.

7. The helmet accessory attachment system as in claim 4, wherein the pivot arm includes a first lock protrusion, and the first blocking surface is on the first lock protrusion.

8. The helmet accessory attachment system as in claim 4, wherein the pivot arm causes a first lock protrusion to rotate when the pivot arm rotates, and the first blocking surface is on the first lock protrusion.

9. The helmet accessory attachment system as in claim 7, wherein the pivot arm further includes a second lock protrusion, and the second lock protrusion includes a third blocking surface such that when the pivot arm is in the locked position, the third blocking surface is positioned relative to a fourth blocking surface on the helmet mount to prevent movement of the accessory attachment member mount relative to the helmet mount.

10. The helmet accessory attachment system as in claim 4, wherein the helmet mount includes a rail and the rail includes the elongate slot.

11. The helmet accessory attachment system as in claim 4, wherein the lock includes a snap lock to hold the pivot arm in a locked position.

12. The helmet accessory attachment system as in claim 1, further comprising a mandible guard attached to the accessory attachment member.

13. The helmet accessory attachment system as in claim 1, further comprising a helmet, and wherein the helmet mount is attached to the helmet.

14. The helmet accessory attachment system as in claim 1, further comprising a second helmet mount having a second helmet-facing surface, the second helmet mount being positioned on a lateral side of the helmet opposite to the helmet mount;

a second accessory attachment member having a second accessory attachment member mount configured to engage with the second helmet mount such that the engagement of the second accessory attachment member with the second helmet mount supports the second accessory attachment member from the second helmet mount;

a second lock to secure the second accessory attachment member to the helmet, the second lock including a second pivot arm and a third blocking surface, and the second pivot arm having an unlocked position and a locked position;

wherein the second pivot arm is pivotable about a second pivot axis that is not perpendicular to the second helmet-facing surface of the second accessory attachment member mount at the second pivot axis location; and wherein when the second pivot arm is in the locked position, the third blocking surface is positioned relative to a fourth blocking surface on the second helmet mount to prevent movement of the second accessory attachment member mount relative to the second helmet mount.

15. A mandible guard attachment system configured to attach a mandible guard to a helmet, the attachment system comprising:

a helmet mount having a helmet-facing surface;

a mandible guard attachment member having a mandible guard attachment member mount configured to engage with the helmet mount such that the engagement of the mandible guard accessory attachment member mount with the helmet mount supports the accessory attachment member from the helmet mount;

a lock to secure the mandible guard accessory attachment member to a helmet, the lock including a pivot arm and a first blocking surface, and the pivot arm having an unlocked position and a locked position, wherein the lock is positioned on the mandible guard attachment member mount; and wherein when the pivot arm is in the locked position, the first blocking surface is positioned relative to a second blocking surface on the helmet mount to prevent movement of the accessory attachment member mount relative to the helmet mount.

16. The mandible guard attachment system as in claim 15, wherein when the pivot arm is in the locked position, the first blocking surface protrudes from the mandible guard attachment member mount.

17. The mandible guard attachment system as in claim 15, wherein:

the helmet mount includes an elongate slot;

the mandible guard attachment member mount includes a slidable insert slidable in the elongate slot; and when the pivot arm is in the locked position, the first blocking surface protrudes from an underside of the slidable insert.

18. The mandible guard attachment system as in claim 17, wherein the slidable insert is slidable into the elongate slot at a temple region of the helmet, and the lock is positioned on the slidable insert at the temple region of the helmet.

19. The helmet accessory attachment system as in claim 15, further comprising a helmet, and wherein the helmet mount is attached to the helmet.

20. A helmet accessory attachment system configured to attach a helmet accessory to a helmet, the attachment system comprising:

a helmet mount having a helmet-facing surface;

a helmet accessory attachment member having a slidable insert configured to engage with the helmet mount such that the engagement of the slidable insert with the helmet mount supports the helmet accessory attachment member from the helmet mount; and a lock to secure the helmet accessory attachment member to a helmet, the lock including a pivot arm and a first blocking surface, and the pivot arm having an unlocked position and a locked position, wherein the lock is positioned on the slidable insert;

wherein when the pivot arm is in the locked position, the first blocking surface is positioned relative to a second blocking surface on the helmet mount to prevent movement of the slidable insert to the helmet mount; and when the pivot arm is in the locked position, the first blocking surface protrudes from an underside of the slidable insert.

21. The helmet accessory attachment system as in claim 20, wherein the helmet mount includes an elongate slot into which the slidable insert is slidable.

22. The helmet accessory attachment system as in claim 20, wherein the pivot arm pivot axis is substantially parallel to the helmet-facing surface of the accessory attachment member mount at the pivot axis location.

23. The helmet accessory attachment system as in claim 20, wherein the pivot arm pivot axis is parallel to the helmet-facing surface of the accessory attachment member mount at the pivot axis location.

24. The helmet accessory attachment system as in claim 20, further comprising a helmet, and wherein the helmet mount is attached to the helmet.

* * * * *